United States Patent [19]

Mackles

[11] 4,041,130

[45] Aug. 9, 1977

[54] PROCESS FOR DESULFURIZATION OF COKE OVEN GAS

[75] Inventor: Mark Mackles, Tarzana, Calif.

[73] Assignee: The Ralph M. Parsons Company, Pasadena, Calif.

[21] Appl. No.: 644,759

[22] Filed: Dec. 29, 1975

[51] Int. Cl.[2] ..... B01D 53/34

[52] U.S. Cl. ..... 423/220; 423/244; 423/245; 423/564; 423/573 G

[58] Field of Search ..... 423/210, 220, 242, 244, 423/563, 573, 228, 232, 223, 245, 564, 574, 248

[56] References Cited

U.S. PATENT DOCUMENTS 3,752,877 8/1973 Beavon ..... 423/573 X

FOREIGN PATENT DOCUMENTS 2,062,138 6/1971 France ..... 423/228

*Primary Examiner*—Earl C. Thomas

*Attorney, Agent, or Firm*—Christie, Parker & Hale

[57] ABSTRACT

A process for reducing the sulfur content of coke oven gas containing hydrogen sulfide, organo-sulfur compounds, and at least one inorganic carbon-sulfur compound, comprises treating the gas stream to remove most of the hydrogen sulfide and then catalytically hydrogenating and/or hydrolyzing the organo-sulfur and carbon-sulfur compounds at an elevated temperature and a partial hydrogen pressure of at least 10 psia, followed by extraction of the remaining and formed hydrogen sulfide.

25 Claims, 2 Drawing Figures

PROCESS FOR DESULFURIZATION OF COKE OVEN GAS

BACKGROUND OF THE INVENTION

Coke oven gas may be catalytically reformed to produce the hydrogen which is essential to reduction of the iron ore. Coke over gas typically contains appreciable quantities of hydrogen sulfide, organo-sulfur compounds such as thiophene, tetrahydrothiophene, thionin, and thioxanthene and inorganic carbon-sulfur compounds such as carbon disulfide and carbonyl sulfide.

It has been found that when the sulfur content of the coke oven gas is greater than about 7 parts per million by volume sulfur expressed as hydrogen sulfide, the sulfur poisons the catalyst during the reforming operation. This necessitates frequent regeneration or replacement of the catalyst.

Therefore, there is a need for a process for reducing the sulfur content of coke oven gas to levels tolerable by the reforming operation as well as hydrogen consuming steel making operations. Equivalent problems exist in other hydrogen consuming processes where the presence of sulfur compounds cannot be tolerated.

SUMMARY OF THE INVENTION

I have invented a continuous process for reducing the the sulfur content of a feed gas stream which contains as sulfur species hydrogen sulfide, at least one organo-sulfur compound, and an inorganic carbon-sulfur compound selected from the group consisting of carbon disulfide, carbonyl sulfide, and mixtures thereof, to negligible quantities of sulfur.

In this process the feed gas stream is first treated to remove most of the hydrogen sulfide, preferably by contact with a hydrogen sulfide absorption solution. The other sulfur compounds in the feed stream are converted to hydrogen sulfide in a reaction stage so that they also can be removed from the feed stream. To prepare the treated feed gas stream for feed to the reaction stage, the feed gas stream is compressed so that the partial pressure of hydrogen in the treated feed gas stream is at least about 10 psia at a temperature sufficient for the catalytic hydrogenation of the sulfur species to hydrogen sulfide. The gas stream is then heated to a temperature sufficient for the catalytic hydrogenation of the sulfur species to form a reaction feed gas stream.

In the reaction stage at least the organo-sulfur compounds in the reaction stage feed gas stream are hydrogenated while simultaneously the inorganic carbon-sulfur compounds are hydrolyzed in the presence of contained water and a catalyst, typically at a temperature from about 300° to about 800° F. The preferred temperature in the reaction stage is from about 500° to about 800° F. The effluent gas stream from the reaction stage typically contains less than about 2 parts per million by volume of sulfur in forms other than hydrogen sulfide. The effulent gas stream from the reaction stage is then treated in a hydrogen sulfide extraction zone to remove the hydrogen sulfide formed by the hydrogenation of the organo-sulfur compounds and hydrolysis of the inorganic carbon-sulfur compounds.

In one embodiment of this invention, the process may be autothermal, wherein the compressed gas stream is heated to its catalytic hydrogenation initiation temperature solely by indirect heat exchange with the effluent gas stream from the reaction stage. In a non-autothermal embodiment of this invention the compressed gas stream is heated to its catalytic initiation temperature by both indirect heat exchange with the effluent gas stream from the reaction stage and an energy source external to the process. In this embodiment the effluent gas stream from the reaction stage is used to drive a compression stage to compress the treated feed gas stream.

In the autothermal embodiment of the invention the reaction stage feed gas stream typically becomes heated to a temperature from about 50° F higher than its inlet temperature in the reactor stage, and, depending on the gas composition, to as high as 120° F higher. In the non-autothermal embodiment, the reaction stage feed gas stream may become heated to a temperature above its inlet temperature in the reactor, but since work is extracted from the hot reactor effluent, a heat source is available to heat the reaction stage feed stream to reaction temperature. Where there are unsaturated inorganic compounds in the feed gas, the reactor stage feed gas stream is heated in the reactor stage by the exothermic catalytic hydrogenation of the unsaturated organic compounds. Heat also is provided for raising the temperature of the reactor stage feed gas stream in the reactor stage by the water gas reaction. If there is an inadequate amount of contained water in the reaction stage feed gas stream to heat it to the desired reaction stage outlet temperature and to effect the hydrolysis of COS and $CS_2$, water is added to the reactor.

In the preferred embodiment of this process the hydrogen sulfide is removed from the feed gas stream by contacting the feed gas stream with a hydrogen sulfide absorption solution. The contacting preferably occurs in a venturi scrubber stage using absorption solution previously used to remove hydrogen sulfide from the effluent gas stream. The absorption solution preferably is selected from the group consisting of aqueous alkaline solutions and aqueous alkaline salt solutions. The hydrogen sulfide in then oxidized after absorption to elemental sulfur, using a catalyst selected from the group consisting of sodium vanadate, sodium anthraquinone disulfonate, sodium arsenate, sodium ferrocyanide, iron oxide and iodine.

Similarly, it is preferred that the hydrogen sulfide be removed from the effluent gas stream from the reaction stage by contacting the effluent stream with a hydrogen sulfide absorption solution. It is preferred that this absorption solution have the same composition as that used for the hydrogen sulfide absorbed from the feed gas stream. For economy of operation, the same hydrogen sulfide absorption solution may first contact the effluent gas stream from the reaction stage and then the feed gas stream to remove hydrogen sulfide.

The catalyst used in the reaction stage preferably is a supported catalyst containing at least one metal selected from a group consisting of the Rare Earth Series and Groups Va, VIa and VIII of the Periodic Table as defined by Mendeleeff. Preferably the catalyst contains at least one of the metals selected from the group consisting of cobalt, molybdenum, iron, chromium, vanadium, thoria, nickel, tungsten and uranium, normally in the sulfide state.

When this process is used to treat a feed gas stream containing carbon monoxide, hydrogen, hydrogen sulfide, organo-sulfur compounds, and a inorganic carbon-sulfur compound, the sulfur content of the gas stream is reduced to less than about 7 parts per million by volume expressed as hydrogen sulfide. Thus this process is effective for treating coke oven gas so that the coke oven gas can be reformed to produce hydrogen for use in an iron ore reduction operation.

These and other features, aspects and advantages of the present invention will become more apparent from the following drawing, description and appended claims.

DRAWINGS

DESCRIPTION OF THE INVENTION

Figure 1:
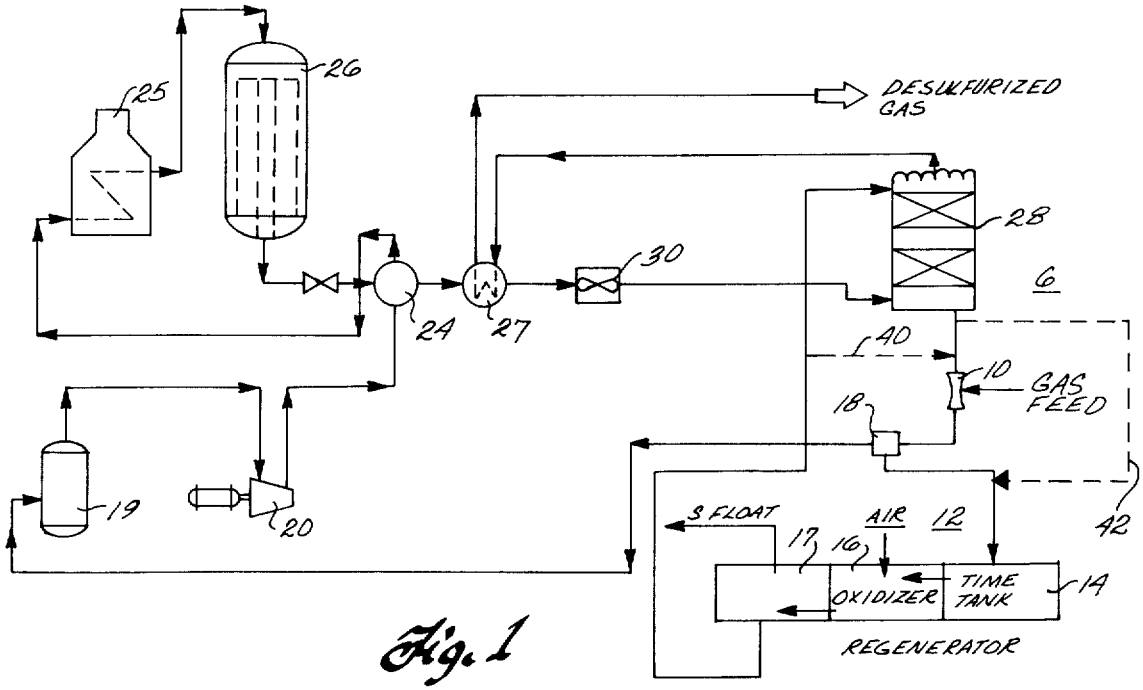
FIG. 1 depicts an autothermal process embodying features of this invention.

The present invention relates to a continuous process for reducing the sulfur content of feed gas streams such as coke oven gas.

Typically these gas streams contain besides desired constituents such as hydrogen and carbon monoxide, intolerable sulfur species such as hydrogen sulfide, organo-sulfur compounds such as thiophene, tetrahydrothiophene, thionin, thioxanthene and the like, and inorganic carbon-sulfur compounds such as carbon disulfide and carbonyl sulfide. Water may also be contained in the feed gas stream. The purpose of this process is to reduce sulfur content of the feed gas stream to negligible quantities, e.g. 4 parts per million by volume (ppm) or less expressed as hydrogen sulfide.

Generally the process involves the step of treating the feed gas stream for bulk removal of the hydrogen sulfide in the feed gas stream, followed by the steps of catalytically hydrogenating and hydrolyzing in a reaction stage the other sulfur compounds in the feed gas stream to hydrogen sulfide, which is removed in a second absorption stage. Prior to the catalytic hydrogenation and hydrolysis reactions, the feed gas stream is compressed so that the partial pressure of the hydrogen in the treated feed gas stream is at least about 10 psia at a temperature sufficient for the catalytic hydrogenation of the sulfur species to hydrogen sulfide. The feed gas stream is then heated to a temperature sufficient for the catalytic hydrogenation of the sulfur species. The hydrogen sulfide formed during the catalytic hydrogenation and hydrolysis reactions occurring in the reaction stage are removed in a hydrogen sulfide extraction zone, thereby yielding a product gas essentially free of sulfur compounds.

Most of the hydrogen sulfide contained in the feed gas stream must be removed prior to the catalytic hydrogenation. and hydrolysis steps in the reactor stage because hydrogen sulfide suppresses the hydrolysis of inorganic carbon-sulfur compounds. The feed gas stream must be compressed prior to hydrogenation and hydrolysis in the reaction stage because organo-sulfur compounds can be hydrogenated efficiently only where the partial pressure of hydrogen is at least about 10 psia.

Feed as streams for which this process is useful include coke oven gas. Typically coke oven gas contains about 6 to 7% by volume carbon monoxide, about 58% by volume nitrogen, about 100 ppm inorganic carbon-sulfur compounds such as carbonyl sulfide and carbon disulfide, about 3500 ppm hydrogen sulfide, and about 100 ppm organo-sulfur compounds such as thiophene. Other compounds which may be present in coke oven gas include carbon dioxide, methane, nitrogen, unsaturated hydrocarbons, hydrogen cyanide, oxygen, ammonia, and nitrogen oxides.

In the first step of this process the feed gas stream is treated to extract the bulk of the hydrogen sulfide. Any number of extraction methods are feasible for this treating step, with absorption methods being preferred. For instance, the cooled tail gas may be passed through alkaline absorption solutions which are continuously regenerated by oxidation to produce elemental sulfur using catalysts such as sodium vanadate, sodium anthraquinone disulfonate, sodium arsenate, sodium ferrocyanide, iron oxide, iodine and like catalysts.

A convenient alternative is to use absorption solutions containing amines, potassium carbonates and like absorbents for hydrogen sulfide which can be continuously regenerated by steam stripping.

Another but less desirable alternative is alkaline absorption using solutions which are not regenerated, as for example, caustic soda, lime, and ammonium hydroxide solutions.

The absorption system 6 depicted in FIG. 1 is preferred. This involves the alkaline absorption of hydrogen sulfide in a venturi scrubber 10 followed by regeneration in a regenerator 12 by oxidation to produce sulfur. The system shown is known as the Stretford Process, which employs a solution containing sodium carbonate, sodium vanadate and sodium anthraquinone disulfonic acid as the absorbent. The absorbed hydrogen sulfide is oxidized by sodium vanadate to form sulfur in a time tank 14, and the absorbing solution is then regenerated by oxidation with air in an oxidizer 16. The sulfur is recovered from the solution in a recovery stage 17 by conventional means such as flotation, filtration, centrifuging, melting, decantation under pressure, and the like.

Referring to FIG. 1, after the feed gas is treated to remove hydrogen sulfide, the gas and absorption solution are separated in a separator stage 18, and then the feed gas enters a knockout drum 19 where entrained absorption solution is removed. The treated feed gas is then compressed in a compressor 20 to a pressure sufficiently high that the partial pressure of hydrogen in the treated feed gas stream is at least about 10 psia at the catalytic hydrogenation initiation temperature of the compressed gas stream. The gas is then heated to its catalytic hydrogenation initiation temperature by indirect heat exchange in a heat exchanger 24 with the effluent gas stream from a reactor stage 26.

Shown in FIG. 1 is a furnace 25 which also is used to heat the reactor stage feed gas stream, but normally only for startup purposes. In normal operation the heat obtained from the exothermic hydrogenation, hydrolysis and water/gas shift reactions in the reaction stage is sufficient to heat the reactor feed gas to its catalytic initiation temperature by heat exchange between the reactor effluent and the feed gas stream.

As indicated, the feed gas stream must be compressed before it is fed to the reactor stage 26 because organo-sulfur compounds such as thiophene can be hydrogenated efficiently only where the partial pressure of hydrogen in the reactor stage is at least about 10 psia. The partial pressure of hydrogen in the reactor stage typically is from about 10 to about 200 psia, depending upon the organo-sulfur species in the feed gas stream and the difficulty with which they may be hydrogenated.

The minimum catalytic initiation temperature is about 300° F. The maximum temperature required in the reactor stage is about 800° F because reaction rate at this temperature is adequate, and at higher temperatures the formation of carbonyl sulfide and carbon disulfide are favored and the conversion of carbonyl sulfide and carbon disulfide in the feed stream to hydrogen sulfide is supressed. The preferred temperature of the reactor stage is from about 500° to about 800° F.

In the reactor stage 26 the organo-sulfur compounds are catalytically hydrogenated by the hydrogen contained in the feed gas stream to hydrogen sulfide. Useful catalysts are those containing metals of Groups Va, VIa and VIII and the Rare Earth Series of the Periodic Table as defined by Mendeleeff, published as the "Periodic Chart Of The Atoms" by W. N. Welch Manufacturing Company in *Business Week*, April 10, 1965 edition, on page 50, and incorporated herein by reference. The catalyst is supported on a silica, alumina, or silica-alumina base. The preferred catalysts are those containing one or more of the metals cobalt, molybdenum, iron, chromium, vanadium, thoria, nickel tungsten (W), and uranium (U), normally in the sulfide form.

Also occurring simultaneously in the reactor stage is the hydrolysis of carbonyl sulfide and carbon disulfide according to the reaction:

$$COS + H_2O \rightarrow CO_2 + H_2S$$

$$CS_2 + 2H_2O \rightarrow CO_2 + 2H_2S$$

The reactor feed gas stream is heated to a temperature from about 50° F higher, and depending on gas composition, to as high as about 120° F higher than its inlet temperature in the reaction stage 26 so that heat is available for the indirect heating of the reactor feed gas stream in the heat exchanger 24. Energy for heating the gas in the reaction stage is obtained from the exothermic hydrogenation of unsaturated hydrocarbons contained in the feed gas stream. Heat also is obtained from the exothermic hydrolysis of carbonyl sulfide and carbon disulfide. In addition some of the carbon monoxide in the feed gas stream undergoes the exothermic water gas shift reaction with water contained in the feed gas stream to carbon dioxide and hydrogen. If there is insufficient water in the feed gas stream, water is added to the reaction stage 26 to cause the desired degree of reaction and also to generate sufficient heat in the reaction stage so that the process is autothermal.

When the reactor stage 26 is operated at the above described conditions, the reactor stage effluent gas stream normally contains less than about 4 ppm by volume of sulfur in forms other than hydrogen sulfide.

After leaving the reactor stage 26, the effluent gas stream is cooled by indirect heat exchange in the heat exchanger stage 24, and with air, water, or a mixture of the two in a cooler stage 30.

The hydrogen sulfide in the effluent stream from the reaction stage can be removed by any of the processes useful for removing the hydrogen sulfide from the feed gas stream, as discussed above. As shown in FIG. 1, it is preferred that the same system used for the feed gas stream be used for removing the hydrogen sulfide formed in the reactor stage 26 for economy of operation.

Referring to FIG. 1, the effluent from the reactor stage may be cooled by indirect heat exchange in the heat exchanger stage 27 with the effluent gas from an absorber 28 where it contacts freshly oxidized absorption solution. If the effluent gas from the absorber 28 is to be cool, then the heat exchanger stage 27 can be bypassed.

The partially spent absorption solution from the absorber 28 preferably is used to contact the feed gas stream in the venturi scrubber 10. The same absorption solution can be reused for the feed gas stream because there is so little hydrogen sulfide contained in the feed gas stream as compared to the amount contained in the effluent from the reactor stage.

A split flow process for removing hydrogen sulfide from the feed gas stream and the reactor effluent may be used, particularly when the feed gas stream contains a high level of hydrogen sulfide. Instead of contacting the feed gas stream with partially spent absorption solution, fresh absorption can be fed to the venturi scrubber 10 through line 40. In this split flow method, spent absorption solution from the absorber 28 is returned directly to the time tank 14 through line 42.

After the hydrogen sulfide in the reactor effluent is removed in the absorber 28, the effluent gas from the absorber 28 may be used to partially cool the effluent from the reaction stage 26 in the heat exchanger 27 if heat is to be recovered into the product gas. The resultant product gas is passed to its end use.

Figure 2:
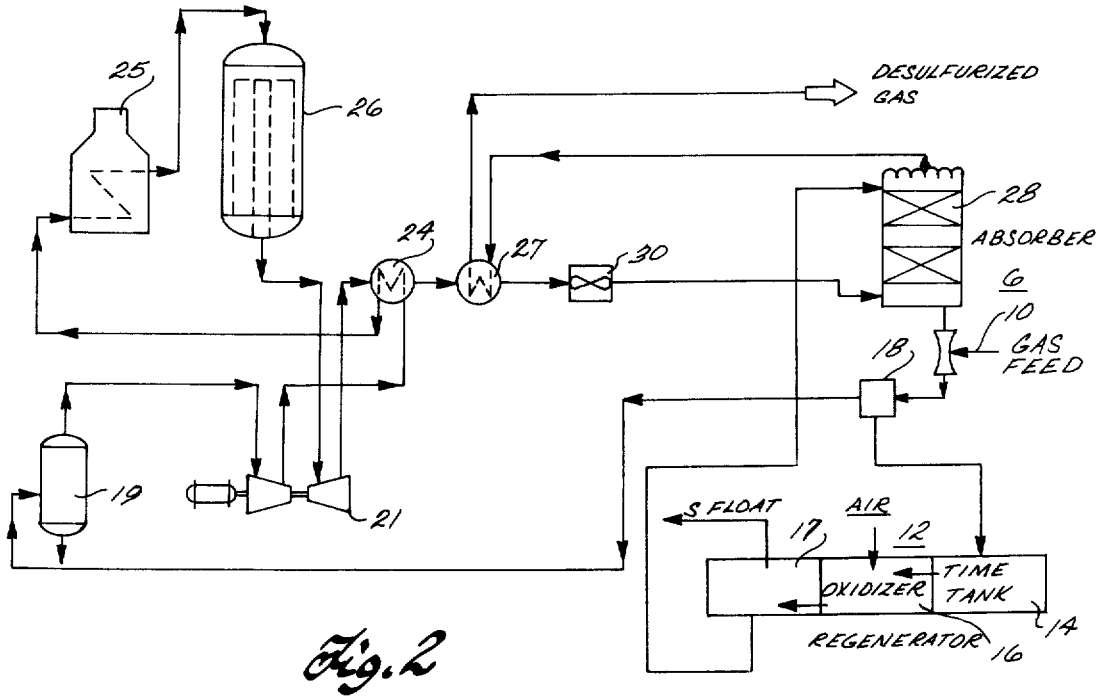
FIG. 2 shows a non-autothermal process embodying features of this invention.

FIG. 2 illustrates another scheme embodying features of this invention in which the process is non-autothermal. Elements in FIG. 2 which are the same as corresponding elements in FIG. 1 have the same number.

In the non-autothermal process of FIG. 2, a heat source external from the process such as the furnace 25 is used not only for startup, but also in the normal operation of the process to heat the reaction stage feed gas stage.

In the embodiment of FIG. 2, it is preferred that the compression of the reactor feed gas stream be at least partially effected by driving the compressor stage 21 with the effluent gas stream from the reaction stage. Thus the energy from outside the process used to heat the reactor feed gas stream is compensated for by driving the compressor stage 21 with the reactor effluent gas stream.

After driving the compressor stage 21, the reactor effluent gas may be used to heat by indirect heat transfer the reactor feed gas stream as is done in the process of FIG. 1.

Essentially, the process of FIG. 2 differs from the process of FIG. 1 in that in the process of FIG. 2 energy is fed into the system by heating the reactor stage gas stream, and this energy is used to drive the compressors rather than using high pressure stream or electrical energy to directly drive the compressors as in the process of FIG. 1.

The split flow process shown in FIG. 1 may also be used with the non-autothermal process of FIG. 2.

Both processes as shown in FIGS. 1 and 2 are useful for reducing the sulfur content of a feed gas stream containing carbon monoxide, hydrogen, hydrogen sulfide, at least one organo-sulfur compound, and an inorganic carbon-sulfur compound to less than about 7 ppm by volume expressed as hydrogen sulfide.

The benefits derived from practice of this invention will be further appreciated from analysis of the appended example.

EXAMPLE

Effluent gas from a coke oven at a dry gas rate of 61,000 standard cubic meters per hour at a pressure of 475 mm $H_2O$ and a temperature of 32° C having the following composition:

| Constituent: | Concentration: |
|---|---|
| CO | 6.5 (vol. %) |
| $CO_2$ | 2.0 (vol. %) |
| $H_2$ | 57.0 (vol. %) |
| $CH_4$ | 26.5 (vol. %) |
| $N_2$ | 4.0 (vol. %) |
| Unsaturates | 3.2 (vol. %) |
| HCN | 100 ppm |
| $NH_3$ | 0.015 g/Nm$^3$ |
| COS | 50 ppm |
| $CS_2$ | 50 ppm |
| $H_2S$ | 4.0 g/Nm$^3$ |
| Thiophene | 100 ppm |
| Naphthalene | 0.05 g/Nm$^3$ |
| Nitrogen oxides | 2 ppm |
| Total sulfur | 4.5 g/Nm$^3$ |
| Light oil | 0.20 gNm$^3$ |
| Tar | 25 mg/Nm$^3$ |
| Dust Loading | 15 mg/Nm$^3$ |

is treated by the process shown in FIG. 1 and described above.

The hydrogen sulfide in the coke oven gas is absorbed in a venturi scrubber with a solution containing sodium carbonate, sodium vanadate, and sodium anthraquinone disulfonate as the absorbent. The gas is separated from the solution in a separator and then the absorbed hydrogen sulfide is oxidized by the sodium vanadate to form sulfur, and the absorbing solution is then regenerated in an oxidizer.

Entrained absorption solution is removed from the gas stream in a knockout drum. The gas stream is then compressed and heated in a heat exchanger by an effluent gas stream from a reactor so that the gas stream temperature is 650° F and the partial pressure of hydrogen in the gas stream is 55 psia. Sulfur species in the compressed and heated gas stream are hydrogenated and hydrolyzed to form hydrogen sulfide in the reactor in the presence of a supported cobalt-molybdate-alumina catalyst while carbon monoxide in the coke oven gas undergoes the water gas shift. The energy released by these exothermic reactions heats the gas in the reactor to 700° F.

The effluent gas from the reactor is used to heat the reactor feed gas and then the formed hydrogen sulfide is absorbed by regenerated absorbing solution. This absorbing solution is subsequently used to absorb the hydrogen sulfide in the coke oven gas.

The product gas has a pressure of 3 Atm. absolute at a temperature of 400° F. The composition of the product gas is essentially unchanged from the composition of the feed gas stream except that hydrogen cyanide and ammonia are removed by the process, and the total sulfur content expressed as hydrogen sulfide is about 6 ppm by volume.

Although this invention has been described in considerable detail with reference to certain embodiments thereof, it will be understood that variations and modifications can be effected within the spirit and scope of the invention as described above and defined in the appended claims. For example, although the invention and example have been described in terms of the feed gas stream from a coke oven, other feed gas streams containing carbon monoxide, hydrogen, hydrogen sulfide, organo-sulfur compounds and inorganic carbon-sulfur compounds can successfully be treated by the method of this invention.

What is claimed is:

1. A continuous process for reducing the sulfur content of a feed gas stream which contains hydrogen, water, and as sulfur species, hydrogen sulfide, at least one organo-sulfur compound, and an inorganic carbon-sulfur compound selected from the group consisting of carbon disulfide, carbonyl sulfide, and mixtures thereof, which comprises:

a. treating the feed gas stream to remove hydrogen sulfide in a hydrogen sulfide extraction zone;

b. compressing the treated feed gas stream to provide a partial pressure of hydrogen in the treated feed gas stream of at least about 10 psia when at a temperature sufficient for the catalytic hydrogenation of such a sulfur species to hydrogen sulfide;

c. heating the compressed gas stream to a temperature sufficient for the catalytic hydrogenation of such a sulfur species to hydrogen sulfide to form a reaction stage feed gas stream;

d. catalytically hydrogenating such an organo-sulfur compound to hydrogen sulfide in the reaction stage feed gas stream in a reaction stage at a temperature sufficient for catalytic hydrogenation of such a sulfur species while simultaneously hydrolyzing in the presence of water contained in the feed gas stream the inorganic carbon-sulfur compounds to hydrogen sulfide to provide an effluent gas stream at a temperature substantially above the reaction stage feed gas stream temperature; and e. cooling and treating the effluent gas stream from the reaction stage to remove hydrogen sulfide in a hydrogen sulfide extraction zone.

2. A process as claimed in claim 1 in which the hydrogen sulfide is extracted from the feed and effluent gas streams by contacting the gas streams with a hydrogen sulfide absorption solution.

3. A process as claimed in claim 2 wherein the hydrogen sulfide absorption solution is selected from the group consisting of aqueous alkaline solutions and aqueous alkaline salt solutions.

4. A process as claimed in claim 3 wherein the removed hydrogen sulfide is oxidized to elemental sulfur using a catalyst selected from the group consisting of sodium vanadate, sodium anthraquinone disulfonate, sodium arsenate, sodium ferrocyanide, iron oxide and iodine.

5. A process as claimed in claim 2 wherein hydrogen sulfide is extracted from the feed and effluent gas streams in a common hydrogen sulfide absorption solution.

6. A process as claimed in claim 1 in which the reaction stage feed gas stream is at a temperature of at least about 500° F and the effluent gas stream is at a temperature up to about 800° F.

7. A process as claimed in claim 1 in which essentially all of the heat required to heat the compressed gas stream is provided by indirect heat exchange between the compressed gas stream and the effluent gas stream.

8. A process as claimed in claim 1 wherein the treated gas stream is compressed in a compressor stage driven with the effluent gas stream from the reaction stage.

9. A process as claimed in claim 1 wherein the catalyst is a supported catalyst containing at least one metal selected from a group consisting of the Rare Earth Series and Groups Va, VIa and VIII of the Periodic Table.

10. A process as claimed in claim 1 wherein the catalyst is a supported catalyst containing at least one metal selected from the group consisting of cobalt, molybdenum, iron, chromium, vanadium, thoria, nickel, tungsten and uranium.

11. A continuous autothermal process for reducing the sulfur content of a feed gas stream which contains hydrogen, water, and as sulfur species, hydrogen sulfide, at least one organo-sulfur compound, and an inorganic carbon-sulfur compound selected from the group consisting of carbon disulfide, carbonyl sulfide, and mixtures thereof, which comprises:

a. treating the feed gas stream by contacting it with a hydrogen sulfide absorption solution in a hydrogen sulfide extraction zone to remove hydrogen sulfide;
b. compressing the treated feed gas stream to provide a partial pressure of hydrogen in the treated feed gas stream of at least about 10 psia when at a temperature sufficient for the catalytic hydrogenation of such a sulfur species to hydrogen sulfide;
c. heating the compressed gas stream to a temperature sufficient for the catalytic hydrogenation of such a sulfur species to hydrogen sulfide to form a feed gas stream to a reaction stage essentially only by indirect heat exchange with an effluent gas stream from the reaction stage;
d. catalytically hydrogenating such an organo-sulfur compound to hydrogen sulfide in the reaction stage feed gas stream in the reaction stage at a temperature from about 300° to about 800° F while simultaneously hydrolyzing the inorganic carbon-sulfur compounds in the presence of water contained in the feed gas stream to hydrogen sulfide to produce the effluent gas stream at a temperature sufficiently high to heat the compressed treated gas stream to a temperature sufficiently high for catalytic hydrogenation of such a sulfur species to hydrogen sulfide;
e. cooling the effluent gas stream from the reaction stage by indirect heat exchange with the compressed gas stream; and
f. contacting the cooled effluent gas stream for the reaction stage with a hydrogen sulfide absorption solution in a hydrogen sulfide extraction zone to remove hydrogen sulfide.

12. A process as claimed in claim 11 in which the reaction stage feed gas stream is at a temperature of at least about 500° F and the effluent gas stream is at a temperature up to about 800° F.

13. A process as claimed in claim 11 wherein the hydrogen sulfide absorption solution for the feed and effluent gas streams is selected from the group consisting of aqueous alkaline solutions and aqueous alkaline salt solutions.

14. A process as claimed in claim 13 wherein the removed hydrogen sulfide is oxidized to elemental sulfur using a catalyst selected from the group consisting of sodium vanadate, sodium anthraquinone disulfonate, sodium arsenate, sodium ferrocyanide, iron oxide and iodine.

15. A process as claimed in claim 11 wherein the catalyst is a supported catalyst containing at least one metal selected from a group consisting of the Rare Earth Series and Groups Va, VIa and VIII of the Periodic Table.

16. A process as claimed in claim 11 wherein the catalyst is a supported catalyst containing at least one metal selected from the group consisting of cobalt, molybdenum, iron, chromium, vanadium, thoria, nickel, tungsten and uranium.

17. A continuous process for reducing the sulfur content of a feed gas stream which contains hydrogen, water, and as sulfur species, hydrogen sulfide, at least one organo-sulfur compound, and an inorganic carbon-sulfur compound selected from the group consisting of carbon disulfide, carbonyl sulfide, and mixtures thereof, which comprises:

a. treating the feed gas stream by contacting it with a hydrogen sulfide absorption solution in a hydrogen sulfide extraction zone to remove hydrogen sulfide;
b. compressing the treated feed gas stream by driving a compressor stage with an effluent gas stream from a reaction stage to provide a partial pressure of hydrogen in the treated feed gas stream of at least about 10 psia when at a temperature sufficient for the catalytic hydrogenation of such a sulfur species to hydrogen sulfide;
c. heating the compressed gas stream to a temperature sufficient for the catalytic hydrogenation of such a sulfur species to hydrogen sulfide to form a reaction stage feed gas stream by indirect heat exchange with the effluent stream from the reaction stage and with an external heat source;
d. catalytically hydrogenating such an organo-sulfur compound in the reaction stage feed gas stream to hydrogen sulfide in the reaction stage at a temperature from about 300 to about 800° F while simultaneously hydrolyzing the inorganic carbon-sulfur compounds in the presence of water contained in the feed gas stream to hydrogen sulfide to produce an effluent gas stream at a temperature substantially above the reaction stage feed gas stream temperature;
e. cooling the effluent gas stream from the reaction stage by indirect heat exchange with the compressed gas stream; and
f. contacting the cooled effluent gas stream from the reaction stage with a hydrogen sulfide absorption solution in a hydrogen sulfide extraction zone to remove hydrogen sulfide.

18. A process as claimed in claim 17 in which the reaction stage feed gas stream is at a temperature of at least about 500° F and the effluent gas stream is at a temperature up to about 800° F.

19. A process as claimed in claim 17 wherein the hydrogen sulfide absorption solution for the feed and effluent gas streams is selected from the group consisting of aqueous alkaline solutions and aqueous alkaline salt solutions.

20. A process as claimed in claim 19 wherein the removed hydrogen sulfide is oxidized to elemental sulfur using a catalyst selected from the group consisting of sodium vanadate, sodium anthraquinone disulfonate, sodium arsenate, sodium ferrocyanide, iron oxide and iodine.

21. A process as claimed in claim 17 wherein the catalyst is a supported catalyst containing at least one metal selected from a group consisting of the Rare Earth Series and Groups Va, VIa and VIII of the Periodic Table.

22. A process as claimed in claim 17 wherein the catalyst is a supported catalyst containing at least one metal selected from the group consisting of cobalt, molybdenum, iron, chromium, vanadium, thoria, nickel, tungsten and uranium.

23. A process as claimed in claim 1 in which the reaction stage is at a temperature from about 300° to about 800° F.

24. A continuous process for reducing the sulfur content of a feed gas stream which contains hydrogen, water, and as sulfur species, hydrogen sulfide, at least one organo-sulfur compound, and an inorganic carbon-sulfur compound selected from the group consisting of carbon disulfide, carbonyl sulfide, and mixtures thereof, which comprises:

a. treating the feed gas stream to remove hydrogen sulfide in a hydrogen sulfide extraction zone;
b. compressing the treated feed gas stream to provide a partial pressure of hydrogen in the treated feed gas stream of at least about 10 psia when at a temperature sufficient for the catalytic hydrogenation of such a sulfur species to hydrogen sulfide;
c. heating the compressed gas stream to a temperature sufficient for the catalytic hydrogenation of such a sulfur species to hydrogen sulfide to form a reaction stage feed gas stream, said heating being at least partially effected by indirect heat exchange with an effluent gas stream from the reaction stage;
d. catalytically hydrogenating such an organo-sulfur compound to hydrogen sulfide in the reaction stage feed gas stream in a reaction stage at a temperature sufficient from catalytic hydrogenation of such a sulfur species while simultaneously hydrolyzing in the presence of water contained in the feed stream the inorganic carbon-sulfur compounds to hydrogen sulfide to provide an effluent gas stream at a temperature substantially above the reaction stage feed gas stream temperature;
e. cooling the effluent gas stream from the reaction stage by indirect heat exchange with the compressed gas stream; and
f. treating the effluent gas stream from the reaction stage to remove hydrogen sulfide in a hydrogen sulfide extraction zone.

25. A continuous process for reducing the sulfur content of a feed gas stream which contains hydrogen, water, and as sulfur species, hydrogen sulfide, at least one organo-sulfur compound, and an inorganic carbon-sulfur compound selected from the group consisting of carbon disulfide, carbonyl sulfide, and mixtures thereof, which comprises:

a. treating the feed gas stream to remove hydrogen sulfide in a hydrogen sulfide extraction zone;
b. compressing the treated feed gas stream to provide a partial pressure of hydrogen in the treated feed gas stream of at least about 10 psia when at a temperature sufficient for the catalytic hydrogenation of such a sulfur species to hydrogen sulfide;
c. heating the compressed gas stream to a temperature sufficient for the catalytic hydrogenation of such a sulfur species to hydrogen sulfide to form a reaction stage feed gas stream;
d. catalytically hydrogenating such an organo-sulfur compound to hydrogen sulfide in the reaction stage feed gas stream in a reaction stage at a temperature from about 300° to 800° F while simultaneously hydrolyzing in the presence of water contained in the feed gas stream and water added to the reaction stage the inorganic carbon-sulfur compounds to hydrogen sulfide to provide an effluent gas stream at a temperature substantially above the reaction stage feed gas stream temperature; and
e. cooling and treating the effluent gas stream from the reaction stage to remove hydrogen sulfide in a hydrogen sulfide extraction zone.

* * * * *